US005147076A

United States Patent [19]

Zanotelli

[11] Patent Number: 5,147,076

[45] Date of Patent: Sep. 15, 1992

[54] DEVICE FOR CLOSING CONTAINERS AND POURING LIQUIDS FROM THEM

[75] Inventor: Giovanni F. Zanotelli, Milan, Italy

[73] Assignee: Lever Brothers Company, Division of Conopco, Inc., New York, N.Y.

[21] Appl. No.: 668,000

[22] Filed: Mar. 12, 1991

[30] Foreign Application Priority Data

Mar. 13, 1990 [IT] Italy ..... 67170 A/90

[51] Int. Cl.[5] ..... B67D 3/00

[52] U.S. Cl. ..... 222/484; 222/521; 222/548

[58] Field of Search ..... 222/482, 484, 489, 519, 222/520, 521, 548, 562, 525, 212

[56] References Cited

U.S. PATENT DOCUMENTS

| | | | |
|---|---|---|---|
| 709,389 | 9/1902 | Booth | 222/489 |
| 2,488,720 | 11/1949 | Ferriday | 222/520 |
| 2,519,705 | 8/1950 | Ruther | 222/525 |
| 3,149,755 | 9/1964 | Porter et al. | 222/548 |
| 3,520,453 | 7/1970 | Stull | 222/542 |
| 3,952,902 | 4/1976 | Prouty et al. | 215/306 |
| 3,955,712 | 5/1976 | Santore | 222/519 |
| 4,065,037 | 12/1977 | Haller | 222/521 |
| 4,261,487 | 4/1981 | Seager | 222/520 |
| 4,643,330 | 2/1987 | Kennedy | 220/288 |
| 4,887,746 | 12/1989 | Dubach | 222/519 |
| 4,917,271 | 4/1990 | Kanner et al. | 222/482 |
| 4,946,080 | 8/1990 | Vesborg | 222/521 |
| 5,016,787 | 5/1991 | Beck | 222/519 |
| 5,048,750 | 9/1991 | Tobler | 222/212 X |

FOREIGN PATENT DOCUMENTS

| | | | |
|---|---|---|---|
| 64022 | 7/1975 | Australia | 222/525 |
| 264152 | 4/1988 | European Pat. Off. . | |
| 296103 | 12/1988 | European Pat. Off. . | |
| 0336188 | 10/1989 | European Pat. Off. | 222/212 |
| 1536129 | 3/1970 | Fed. Rep. of Germany . | |
| 1184239 | 3/1970 | United Kingdom . | |
| 1349530 | 4/1974 | United Kingdom . | |

*Primary Examiner*—Michael S. Huppert
*Assistant Examiner*—Kenneth Bomberg
*Attorney, Agent, or Firm*—Ronald A. Koatz; A. Kate Huffman

[57] ABSTRACT

Device for closing containers and pouring ligands from them, comprising a connecting piece that can be mounted on a mouthpiece of the container and has a central valve seat which defines an annular orifice for the outflow of the liquid, and a cap unit screwed to the connecting piece, which is fitted with a pouring spout, whereby the connecting piece has features such that the height of the pouring device is limited and an auxiliary annular chamber is present around the connecting piece, which chamber is equipped with a vent in its base, which vent ensures equalization of pressure inside the container when liquid is being poured out.

5 Claims, 4 Drawing Sheets

DEVICE FOR CLOSING CONTAINERS AND POURING LIQUIDS FROM THEM

The present invention relates to a device for closing containers and dispensing liquids from them, comprising in particular a connecting piece that can be mounted over the mouth-piece of a container and which has a central valve seat defining an annular aperture for the outflow of the liquid, and a cap unit, which is screwed onto the connecting piece and is fitted with a pouring spout and a central annular shutter. The cap can be put in the closed position or rotated into the pouring position at will, with the annular shutter being in contact with the central valve seat in the first case and separated from it in the second.

The known types of such devices comprise a connecting piece, which is placed between the container and the cap unit, with a lower part that is elastically snapped onto the mouth-piece of the container, and a threaded upper part onto which the cap unit can be screwed. In such cases, however, the connecting piece and hence the closing device are quite tall, and furthermore the containers must have a specially shaped mouth-piece that can take a snap-on coupling with the connecting piece. Besides, the current closing devices are not compatible with the efficient safety seals that are placed between the container and the connecting piece. Furthermore, when liquid is being poured out using the current devices equipped with means for snap-on coupling , the air usually has to enter the container through the liquid outlet orifice, resulting in a non-uniform outflow of liquid.

For instance, EP 0264152 A2 (P&G) discloses a two-piece bottle closure with a pouring spout, which bottle closure does not contain means for pressure equalization when liquid is being poured out, and whereby the connecting piece is provided with a tightening chamber with a snapping bead.

It is an object of the present invention to provide a device outlined at the beginning of this specification, which is free from the above drawbacks and is simple and cheap to make.

To achieve this and other objects the present invention provides a device for closing containers and pouring liquids from them, comprising a connecting piece that can be mounted on a mouth-piece of the container and has a central valve seat which defines an annular orifice for the outflow of the liquid, and a cap unit screwed to the connecting piece, which is fitted with a pouring spout and a central annular shutter and can assume a closed position and a rotated pouring position at will, in which positions the annular shutter is respectively in contact with and separated from the central valve seat, characterized in that the connecting piece has an annular tightening chamber, open on the side opposite the cap unit, and a side wall, which contains internal means for screwing and tightening the connecting piece onto the mouth-piece of the container, whereby an auxiliary annular chamber which is open in the direction of the cap unit is placed radially internal to said annular tightening chamber, said auxiliary annular chamber having a vent essentially in its base, which vent ensures the equalization of the pressure inside the container when liquid is being poured out.

Owing to these features, the device according to the invention is not so tall, and it is therefore less likely to be damaged by being knocked about. Furthermore, it can be fitted onto conventional containers that have a threaded coupling piece and also permits the use of a ratchet-type base seal to prevent the unscrewing of the connecting piece from the coupling piece of the container.

The connecting piece is preferably equipped with a thread on an outside surface of the annular tightening chamber such that suitable "interruptions" for the passage of air result when the cap unit is being screwed onto this thread. As a result, the liquid flow characteristics with respect to uniformity and evenness are further improved because the equalization of the air pressure inside the container when liquid is poured out is further ensured.

According to another feature of the invention, the cap unit has an auxiliary annular shutter that is radially external to the central annular aperture and cooperates tightly with the outside wall of the auxiliary annular chamber when the cap unit is in the closed position. This prevents the outflow of the liquid from the container through said bottom vent of the auxiliary annular chamber.

Other advantages and features of the device according to the invention will emerge from the following detailed description, given as a non-limitative example. In this respect reference is made to the attached drawings, where:

In these drawings, 10 denotes the entire closing and pouring device for liquids, mounted on a container C. The device 10 comprises a connecting piece 12 that is screwed onto a threaded mouth-piece (not shown) of the container C, and a pouring cap 14 that is screwed onto the connecting piece 12.

Figure 3:
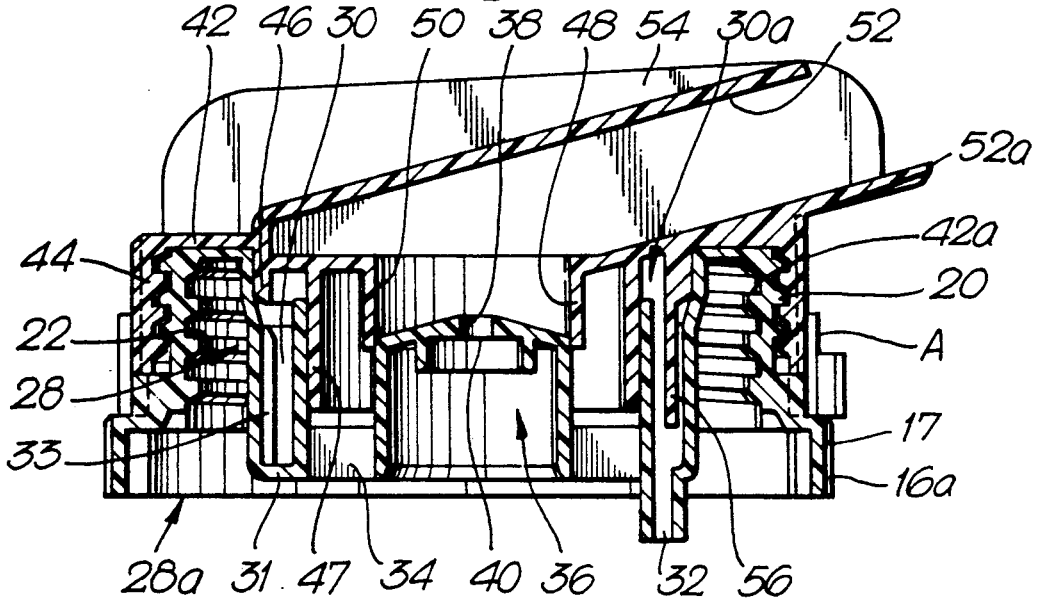
FIG. 3 is a cross-section taken along the line III—III marked in FIG. 1.
Figure 4:
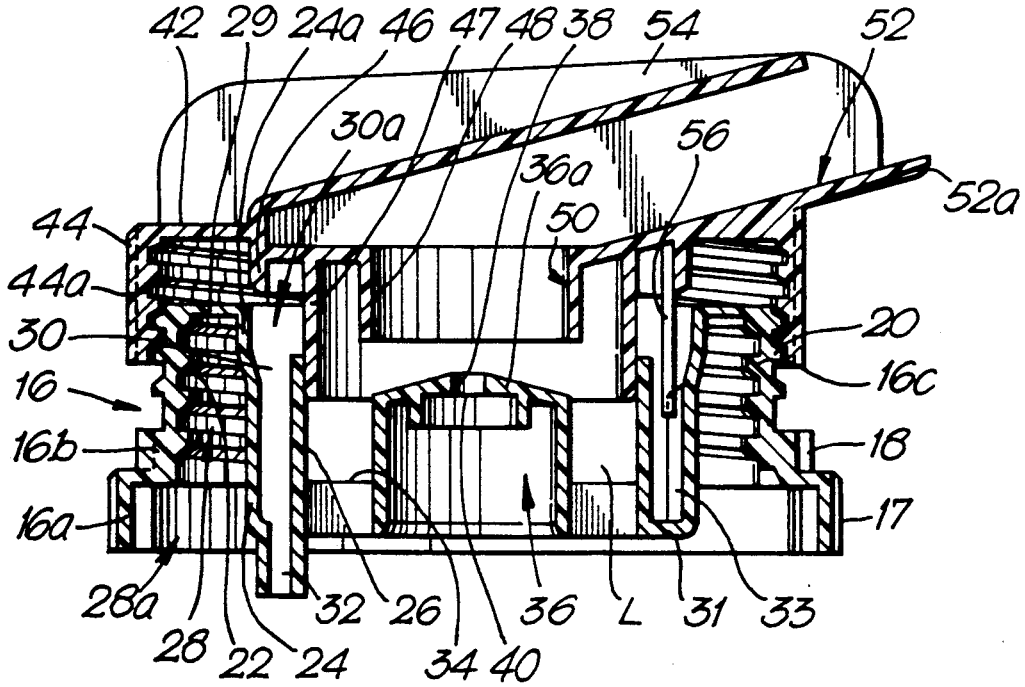
FIG. 4 is a cross-section taken along the line IV—IV marked in FIG. 2.
Figure 5:
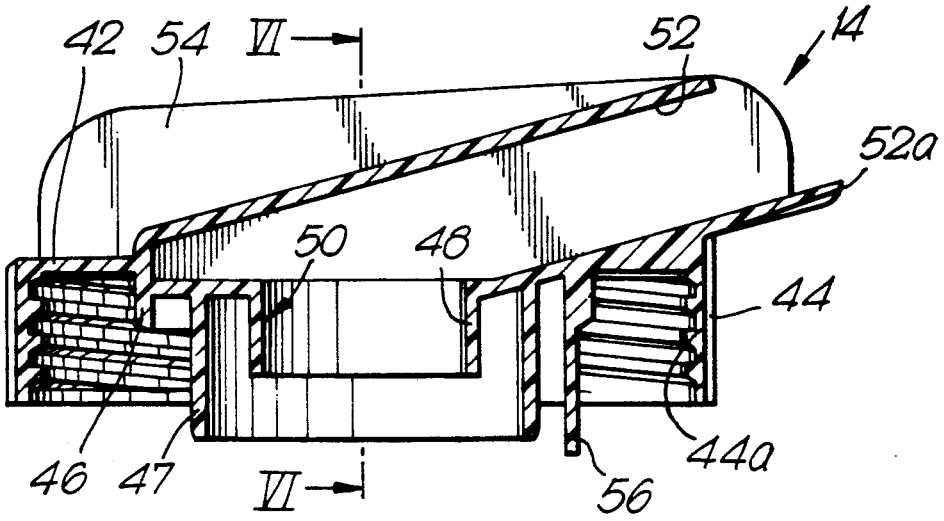
FIG. 5 is a cross-section of part of the device shown in FIGS. 1–4.
Figure 6:
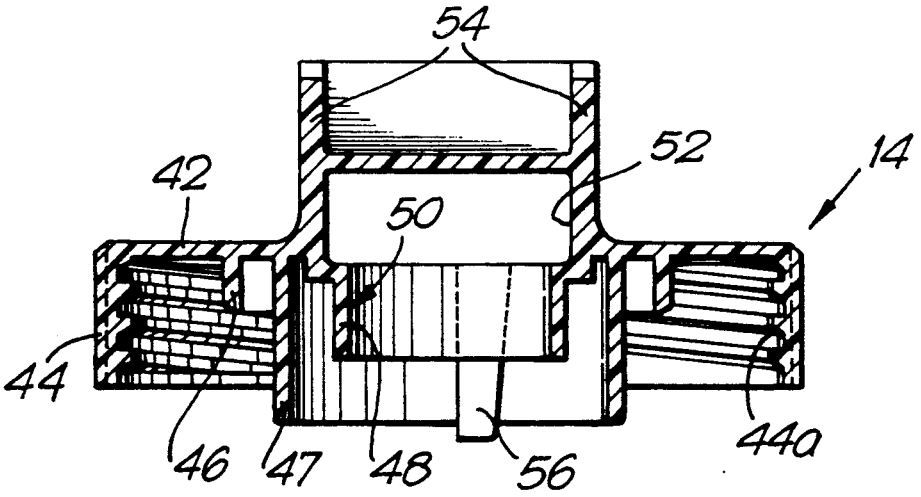
FIG. 6 is a cross-section taken along the line VI—VI marked in FIG. 5.
Figure 7:
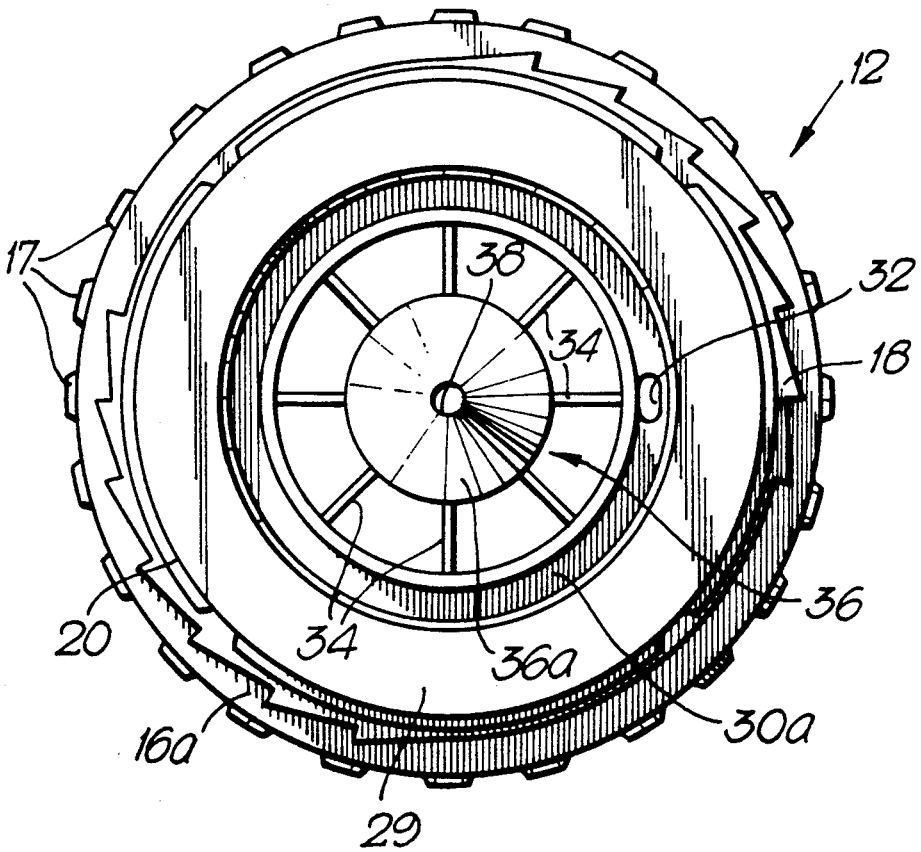
FIG. 7 is a plan view of a second part of the device shown in FIGS. 1–4.

With particular reference to FIGS. 3, 4 and 7, the connecting piece has a circular outer side wall 16 with a collar-like bottom portion **16*a* having adjusting fins 17, an intermediate portion 16*b* with saw-tooth-type peripheral serration 18, and an upper portion 16*c* with a triple-start external screw-thread 20** having "interruptions" for the passage of air while the liquid is being poured out.

The upper portion **16*c* of the outside wall 16 of the connecting piece 12 is fitted internally with a screw-thread 22 that cooperates with the corresponding screw-thread on the mouth-piece of the container C, so that the device 10** can be screwed and tightened onto this container.

The connecting piece 12 also has two concentric annular walls 24 and 26, which define a first annular chamber 28 with an aperture **28*a* in the direction opposite the cap 14, and a second annular chamber 30 with an upper aperture 30*a* facing away from the side opposite the aperture 28*a* of the first annular chamber 28**.

The outside wall 16 and the inside wall 24 of the first annular chamber 28 are connected at the top (in relation to the arrangement of the device mounted on container C) by means of a base 29 intended for being pushed onto the upper edge of the mouth-piece of the container. Furthermore, a slightly conical upper portion 24a of the annular wall 24 that separates the first annular chamber 28 from the second annular chamber 30 is tightly coupled with a corresponding internal surface of the mouthpiece of the container.

The second annular chamber 30 is fitted with an annular base 31 from which an air-intake tube 32 projects downward. The second annular chamber 30 is fitted additionally with a counterpart 33 that protrudes radially from the annular wall 24, separating the first from the second chamber (see below for its function).

The valve seat 36 is fitted centrally on the inside annular wall 26 of the second annular chamber 30 with the aid of radial fins 34. This valve seat is shaped like an upside-down cup and defines an outflow orifice L. The valve seat 36 is fitted with a base 36a, which has a central hole 38, and a vent-covering membrane 40 is arranged over this hole. This membrane 40 prevents the flow of the liquid and permits the passage of air. The base 36a of the valve seat 36 has an upper surface that sinks down to prevent stagnant pools of liquid forming near the membrane 40. The intermediate part of the outside surface of the valve seat 36 has a conical portion that turns down, the aim being to permit a tight coupling with the cap 14.

The cap 14 has a base 42 from which extend downward three concentric annular extensions 46, 47 and 48, and an outside ring 44 with an internal thread 44a to cooperate with the thread 20 on the outside wall 16 of the connecting piece 12.

The first extension 46 has a short height and can form a tight seal with the upper portion 24a of the inside annular wall 24 in the closed position.

The second annular extension 47 is radially internal to the first one, has a greater height, its diameter essentially matches the inside annular wall 26 of the second annular chamber 30, and it cooperates telescopically with the latter in order to ensure a tight closure of the annular outlet orifice L, formed around the valve seat 36.

The third annular extension 48 is radially internal to the second one and has a height intermediate between that of the first and the second extensions. It forms an annular shutter that cooperates with the valve seat 36. The third annular extension 48 is positioned around a central aperture 50 for the flow of the liquid, communicating with the pouring spout 52 having a non-drip edge 52a. There are two adjusting fins 54 fitted beside the pouring spout 52 to facilitate the turning of the cap 14. The spout 52 extends upwards and transversely to the base #42 or the cap 14 and presents an uninterrupted plane for the flow of the liquid. The thickness of this decreases on approaching the end at the edge 52a, the latter being rounded off downward at the back in order to obtain a marked non-drip effect.

The first annular extension 46 inside the cap 14 has—at the pouring spout—an axial extension 56 that projects downward and comes to rest against a counterpart 33 in the second annular chamber 30 when the cap 14 has been turned through an angle of about 180° from the closed position shown in FIG. 3.

Figure 1:
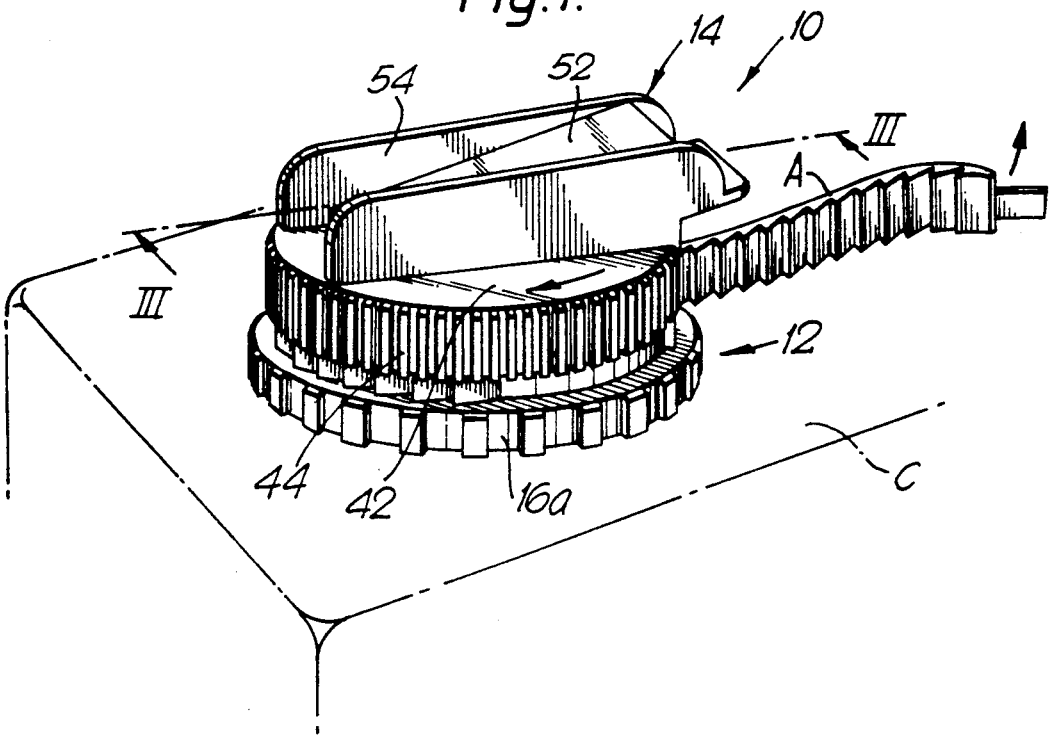
FIG. 1 is a perspective view of a device according to the invention, shown in the closed position, mounted on a container.
Figure 2:
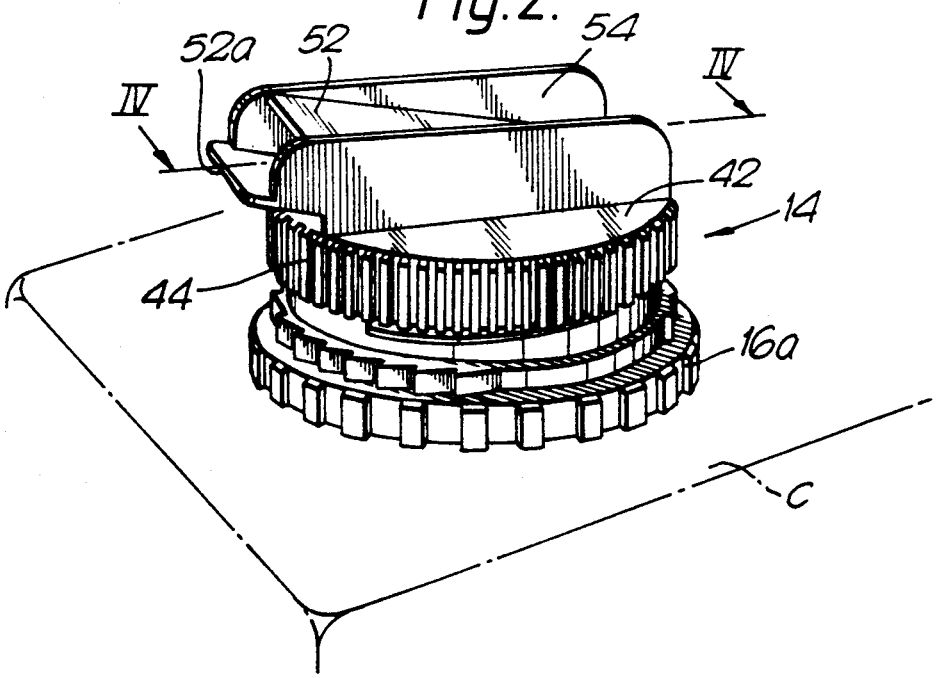
FIG. 2 is a perspective view similar to FIG. 1, showing the device in the open position.

In the sealed position of the device 10, shown in FIG. 3, an intermediate ring A having a double seal with a pull tab joins the connecting piece 12 with the cap unit 14. After pulling the ring A (whose operation is shown in FIG. 1), the user turns the cap 14 through an angle of about 180°, so that the configuration changes from that shown in FIGS. 1 and 3 to that shown in FIGS. 2 and 4, where the cap is illustrated in a rotated position, slightly separated from the connecting piece 12. In this position, the liquid can flow through the annular orifice L, through the aperture 50 and the pouring spout 52. The volume of liquid discharged is replaced by air inside the container C during the pouring operation. This air flows through the "interruptions" in the thread 20, provided on the outside well 16 of the connecting piece 12, through the orifice between the first annular extension 46 and the annular part 24, and through the air intake tube 32 arranged in the bottom 31 of the second annular chamber 30.

When the cap is closed, the annular shutter 48 cooperates with the valve seat 36, preventing the further exit of liquid. Furthermore, the engagement between the first annular extension 46 of the cap 14 and the annular wall 24 of the connecting piece 12 prevents any accidental discharge of liquid through the air outlet tube 32.

In the closed position shown in FIG. 3, any pressure difference between the ambient value and the value inside the container C is equalized, owing to the presence of a semi-permeable membrane 40, which is suitably made of Goretex.

The details of the embodiments and the forms of realization can be very different from the case described and illustrated above without violating the scope of the present invention, provided that the principle of the latter is retained.

I claim:

1. A closure device for containers containing liquids comprising:

connecting means for mounting said closure device on a mouthpiece of a container, said connecting means having a central valve seat defining an annular orifice for the outflow of liquid from the container;

a vent membrane that is permeable to air but impermeable to liquids fitted centrally on the central valve seat;

said connecting means having a circular outer wall provided with internal and external screw threads, the internal screw threads cooperating with threads on the mouthpiece;

a cap unit screwed to the connecting means, the cap unit having threads cooperating with the external screw threads of the circular outer wall of the connecting means and having a pouring spout and an annular shutter collar which are rotatably mounted on the connecting means so that the cap unit can be rotated to a closed position with the annular shutter collar in contact with the central valve seat or to a pouring position with the annular shutter collar separated from the central valve seat;

said connecting means having a first annular inside wall forming a tightening chamber with said outer wall;

said connecting means having a second inside annular wall placed radially internal to said tightening chamber forming an auxiliary annular chamber with said first annular inside wall, the auxiliary annular chamber being open in the direction of the cap unit, and said auxiliary annular chamber having a vent means in the lowest part of its base for equalization of pressure inside the container when liquid is being poured out of the container and through the closure device.

2. Device according claim 1, characterized in that the connecting piece (12) external thread (20) has interruptions for the passage of air.

3. Device according to claim 1, characterized in that the cap unit (14) has an auxiliary annular shutter (46) that is radially external to the annular shutter (48) and can tightly cooperate with the first annular inside wall wall (24*a*, 24) of the auxiliary annular chamber (30) in the closed position of the cap unit (14).

4. Device according to claim 3, characterized in that the said auxiliary annular shutter (46) has an axial extension (56) that cooperates with a corresponding radial counterpart (33) mounted inside the auxiliary annular chamber (30) of the connecting piece (12) in order to limit the rotation of the cap unit.

5. Device according to claim 1, characterized in that the connecting piece (12) has internally a ratchet-type base seal, to prevent the accidental unscrewing of the connecting piece (12) from the mouth of the container (C).

* * * * *